US009275607B2

(12) United States Patent
Albrecht et al.

(10) Patent No.: US 9,275,607 B2
(45) **Date of Patent: *Mar. 1, 2016**

(54) DYNAMIC COLOR ADJUSTMENT FOR DISPLAYS USING LOCAL TEMPERATURE MEASUREMENTS

(71) Applicant: Apple Inc., Cupertino, CA (US)

(72) Inventors: Marc Albrecht, San Francisco, CA (US); Ulrich Barnhoefer, Cupertino, CA (US); Gabriel Marcu, San Jose, CA (US); Sandro H. Pintz, Menlo Park, CA (US); Keith Cox, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/683,201

(22) Filed: Nov. 21, 2012

(65) Prior Publication Data

US 2014/0139570 A1 May 22, 2014

(51) Int. Cl.

| | |
|---|---|
| ***G09G 5/02*** | (2006.01) |
| ***G09G 5/06*** | (2006.01) |
| ***G09G 3/20*** | (2006.01) |

(52) U.S. Cl.

CPC ..... *G09G 5/06* (2013.01); *G09G 3/2003* (2013.01); *G09G 2320/0242* (2013.01); *G09G 2320/041* (2013.01); *G09G 2320/0666* (2013.01); *G09G 2320/0693* (2013.01); *G09G 2360/144* (2013.01)

(58) Field of Classification Search

CPC ..... G09G 3/22; G09G 5/04; G09G 3/2003; G09G 3/3611; G09G 3/3651; G09G 2300/0452; G09G 2340/06; G09G 2320/041; G09G 2300/0456; G09G 3/3607; G09G 2320/0242; G09G 2320/0276; G09G 2320/0666; G09G 5/02; G09G 2320/0626; G09G 2320/0693; G09G 5/06; G09G 2360/144

USPC ..... 345/591, 101, 214, 694, 690

See application file for complete search history.

(56) References Cited

U.S. PATENT DOCUMENTS

| | | | |
|---|---|---|---|
| 5,489,918 | A | 2/1996 | Mosier |
| 6,320,568 | B1 | 11/2001 | Zavracky |
| 6,906,744 | B1 | 6/2005 | Hoshuyama et al. |
| 7,859,554 | B2 | 12/2010 | Young |

(Continued)

OTHER PUBLICATIONS

Albrecht et al., U.S. Appl. No. 13/683,523, filed Nov. 21, 2012.

*Primary Examiner* — Aneeta Yodichkas
*Assistant Examiner* — Chineyere Wills-Burns
(74) *Attorney, Agent, or Firm* — Treyz Law Group, P.C.; Kendall P. Woodruff

(57) ABSTRACT

An electronic device may include a display and display control circuitry. The display may be calibrated to compensate for changes in display temperature. Display calibration information may be obtained during manufacturing and may be stored in the electronic device. The display calibration information may include adjustment factors configured to adjust incoming pixel values to reduce temperature-related color shifts. During operation of the electronic device, display control circuitry may determine the temperature at different locations on the display. The display control circuitry may determine the temperature at a given display pixel using the temperatures at the different locations on the display. The display control circuitry may determine adjustment values based on the temperature at the display pixel. The display control circuitry may apply the adjustment values to incoming pixel values to obtain adapted pixel values, which may in turn be provided to the display pixel.

13 Claims, 15 Drawing Sheets

(56) References Cited

U.S. PATENT DOCUMENTS

2005/0007360 A1* 1/2005 Matsumoto ..... 345/204
2006/0077136 A1 4/2006 Cok
2006/0187232 A1* 8/2006 Kempf et al. ..... 345/591
2008/0036727 A1* 2/2008 Muto ..... G09G 3/3611 345/101
2008/0284712 A1* 11/2008 Muto et al. ..... 345/101
2008/0284775 A1* 11/2008 Shen et al. ..... 345/214
2009/0160878 A1 6/2009 Kwong et al.
2010/0123744 A1* 5/2010 Iba ..... G09G 3/22 345/694
2010/0226487 A1 9/2010 Harder et al.
2011/0032275 A1* 2/2011 Marcu ..... G09G 3/2003 345/690
2012/0119670 A1 5/2012 Vinkenvleugel et al.
2012/0139955 A1* 6/2012 Jaffari ..... G06F 17/5018 345/690
2012/0281008 A1 11/2012 Marcu et al.

* cited by examiner

62

| NEUTRAL (R:G:B=1:1:1) | |
|---|---|
| T1 | RGB1 |
| T2 | RGB2 |
| ⋮ | ⋮ |
| Tm | RGBm |

FIG. 11

64

| YELLOWISH (R:G:B=2:2:1) | |
|---|---|
| T1 | RGB1' |
| T2 | RGB2' |
| ⋮ | ⋮ |
| Tm | RGBm' |

FIG. 12

66

| GREENISH BLUE (R:G:B=1:2:3) | |
|---|---|
| T1 | RGB1" |
| T2 | RGB2" |
| ⋮ | ⋮ |
| Tm | RGBm" |

FIG. 13

DYNAMIC COLOR ADJUSTMENT FOR DISPLAYS USING LOCAL TEMPERATURE MEASUREMENTS

BACKGROUND

This relates generally to electronic devices with displays and, more particularly, to electronic devices with calibrated displays.

Electronic devices such as computers, media players, cellular telephones, set-top boxes, and other electronic equipment are often provided with displays for displaying visual information.

Displays are often capable of displaying color images. However, the color response of a display may change as the display operates. For example, changing operating conditions such as changing display temperature may affect the color response of a display. Some displays depict white as somewhat yellowish when initially powered on and cold. As the display warms, the white point of the display shifts toward a more neutral white, such as that defined by the standard illuminant, D65. Other display colors such as skin tone colors may also experience shifts within a color space as the temperature of the display changes. Similarly, other parameters of the display may shift as a function of temperature such as luminance, black level, contrast, or electro-optical transfer function, which may be referred to as the "native gamma" of the display. This set of parameters may be referred to as the color profile of the display.

The shift in the color profile due to temperature changes in the display generally causes each pixel of the display to change color until a stable operating temperature is achieved, at which point the pixel colors may likewise be stable. That is, although a pixel may be instructed to display the same color at an initial temperature and a stable operating temperature, the actual color displayed, as objectively measured by its chromaticity and luminance, may vary.

Displays are sometimes calibrated to account for temperature induced white point shifts. Conventional methods include applying adjustment factors to incoming pixel values based on a temperature measured at the center of the display. This type of global white point correction neglects local variations in temperature across the display and can exacerbate temperature induced color shifts in localized hotspots or cold spots on the display.

It would therefore be desirable to be able to provide improved ways of calibrating electronic devices with color displays.

SUMMARY

An electronic device may include a display and display control circuitry. The display may be calibrated during manufacturing using a calibration system. The calibration system may include calibration computing equipment coupled to a light sensor and may be used to gather display performance information from the display. The display performance information may be recorded as a function of one or more input parameters such as display temperature. Gathering display performance information may include measuring display luminance and chromaticity values.

Display performance information may be used to calculate color-specific and temperature-dependent adjustment values. For example, a table of adjustment values may be derived for each color in a number of different colors. Each table of adjustment values may include a number of different adjustment values corresponding respectively to different display temperatures. The tables of adjustment values may be stored in the electronic device.

Display control circuitry in the electronic device may use the stored adjustment values to adjust display colors in order to compensate for changes in display temperature.

Display control circuitry may determine the temperature at different locations on the display. Interpolation methods such as Inverse Distance Weighting may be used to determine the temperature at additional locations based on the temperatures at the different locations. Using these temperatures, the display control circuitry may interpolate the temperature at a given display pixel.

In some configurations, the display control circuitry may estimate temperatures at different locations on the display based on the current operating conditions of the display. In other configurations, the display control circuitry may determine temperatures at different locations on the display based on one or more temperatures measured by a temperature sensor.

The display control circuitry may determine adjustment values for the display pixel based on the temperature at the display pixel. The display control circuitry may apply the adjustment values to incoming pixel values to obtain adapted pixel values, which may in turn be provided to the display pixel.

The adjustment values may, if desired, be determined based on the color associated with incoming pixel values. The display control circuitry may determine the color associated with incoming pixel values by determining a ratio of a red pixel value to a green pixel value to a blue pixel value. The display control circuitry may determine adjustment values to apply to the incoming pixel values for a display pixel based on the temperature at the display pixel and the color associated with the incoming pixel values.

If the color associated with the incoming pixel values does not exactly match any of the colors for which adjustment values have been stored, methods such as a combination of Inverse Distance Weighting and Delaunay Triangulation may be used to interpolate adjustment values for the incoming pixel values.

If the color associated with the incoming pixel values matches one of the colors for which adjustment values have been stored, the stored adjustment values may be directly applied to the incoming pixel values.

Further features of the invention, its nature and various advantages will be more apparent from the accompanying drawings and the following detailed description of the preferred embodiments.

BRIEF DESCRIPTION OF THE DRAWINGS

FIG. 11 is an illustrative table of color-specific adjustment values optimized for neutral colors in accordance with an embodiment of the present invention.

FIG. 12 is an illustrative table of color-specific adjustment values optimized for yellowish colors in accordance with an embodiment of the present invention.

FIG. 13 is an illustrative table of color-specific adjustment values optimized for greenish blue colors in accordance with an embodiment of the present invention.

DETAILED DESCRIPTION

Figure 1:
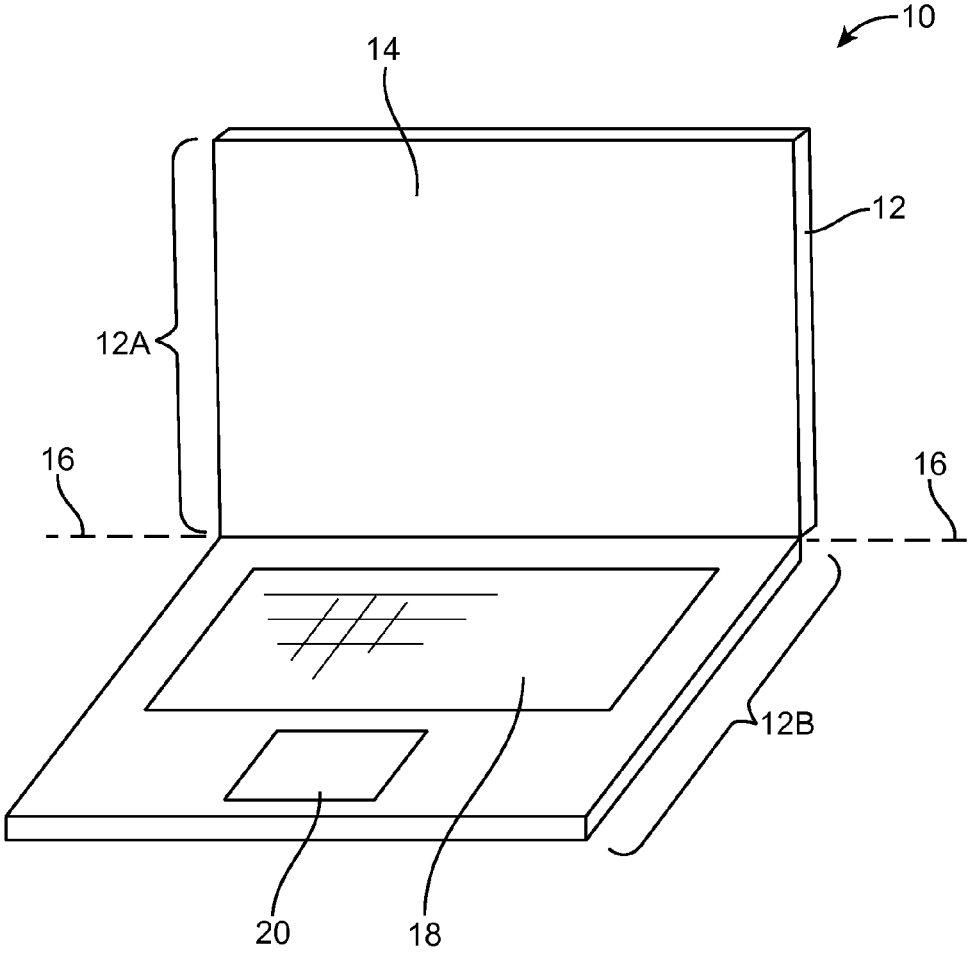
FIG. 1 is a diagram of an illustrative electronic device such as a portable computer having a calibrated display in accordance with an embodiment of the present invention.

Electronic devices such as cellular telephones, media players, computers, set-top boxes, wireless access points, and other electronic equipment may include displays. Displays may be used to present visual information and status data and/or may be used to gather user input data.

Displays may be configured to display color images. For example, displays may include color display pixels configured to create colored light. Individual pixels of a display may receive a red, green, and blue value that together define the color to be created by the pixel. These red, green, and blue values are sometimes referred to herein in the aggregate as an "RGB value," as understood to those of ordinary skill in the art.

If care is not taken, display colors may shift within a color space as the temperature of a display varies. To account for changes in display operating temperature, display colors may be adjusted using adjustment values. For example, an adjustment value may be applied to an input RGB value to obtain an adapted RGB value that accounts for changes in display temperature. The adjustment value may be based on the color associated with the RGB value and on the display temperature. The adjustment value may be found in a look-up table or may be computed by interpolating from the values found in the table. The adjustment value may be applied, depending on the type of display, to an RGB value that may be supplied to a display pixel or to the gain of the red channel, green channel, and blue channel to adjust the colors of the display.

Display colors may be corrected as the display warms up and changes temperature. Display performance information such as luminance and chromaticity values may be recorded for different RGB input values and for every temperature in a set of temperatures. The display may produce a color range that may be referred to herein as the "display color gamut." The display color gamut may be determined based on the recorded data using either a matrix multiplication and gamma correction based model (called the matrix model) or a look-up table and optional interpolation based model, called the "LUT model." Generally, a color model is a way of representing the correspondence between colors as measured by an instrument on the display and the RGB values that produce these colors on the display. The table based model may be created, for example, by empirically measuring luminance and chromaticity for a variety of pixel colors expressed in RGB values and comparing them to desired or perceived luminance and chromaticity values.

These desired values generally correspond to the luminance and chromaticity that are set as the luminance and chromaticity target values for that display. The target may correspond to the luminance and chromaticity of the displayed color when the electronic display has achieved its stable operating temperature. Alternatively, the target may correspond to a different set of luminance and chromaticity values. For example, the target values may be those recommended by a certain standard or selected by the user according to particular needs. As another example, a fixed luminance and D65 reference white point may be used as a target for white. Also, the target may be specified by a luminance and chromaticity value that varies according to a precise function selected by the user. In short, the target luminance and chromaticity for a given color can be an arbitrary set. At various temperature values, certain color models may be more suitable than others for coding the colors produced by that device. There may be multiple color models such that each individual color model corresponds to a specific temperature. Thus, as the temperature of the display increases, the color model of the display (or its component pixels) may change.

A target state of the display may be defined as a chromaticity value and a luminance value of the display. For a specific temperature and color for which the parameters of the color model have been measured, the adjustment values for each R, G, and B components may be computed using the color models and the target luminance and chromaticity value. The RGB adjustment values may be organized into tables such that each line in a given table provides the RGB adjustment values corresponding to specific temperature and a specific color. For an arbitrary color that is not included in the set of tables, the corresponding RGB adjustment values may be computed by interpolating the RGB adjustment values among two or more tables. For an arbitrary temperature value that is not included in a given table, the corresponding RGB adjustment values may be computed by interpolating the RGB adjustment values in that table. These tables may sometimes be referred to herein as RGB adjustment value tables.

An illustrative electronic device of the type that may be provided with a calibrated display is shown in FIG. 1. Electronic device 10 may be a computer such as a computer that is integrated into a display such as a computer monitor, a laptop computer, a tablet computer, a somewhat smaller portable device such as a wrist-watch device, pendant device, or other wearable or miniature device, a cellular telephone, a media player, a tablet computer, a gaming device, a navigation device, a computer monitor, a television, or other electronic equipment.

As shown in FIG. 1, device 10 may include a display such as display 14. Display 14 may be a touch screen that incorporates capacitive touch electrodes or other touch sensor components or may be a display that is not touch-sensitive. Display 14 may include image pixels formed from light-emitting diodes (LEDs), organic light-emitting diodes (OLEDs), plasma cells, electrophoretic display elements, electrowetting display elements, liquid crystal display (LCD) components, or other suitable image pixel structures. Arrangements in which display 14 is formed using liquid crystal display pixels are sometimes described herein as an example. This is, however, merely illustrative. Any suitable type of display technology may be used in forming display 14 if desired.

Device 10 may have a housing such as housing 12. Housing 12, which may sometimes be referred to as a case, may be formed of plastic, glass, ceramics, fiber composites, metal (e.g., stainless steel, aluminum, etc.), other suitable materials, or a combination of any two or more of these materials.

Housing 12 may be formed using a unibody configuration in which some or all of housing 12 is machined or molded as a single structure or may be formed using multiple structures (e.g., an internal frame structure, one or more structures that form exterior housing surfaces, etc.).

As shown in FIG. 1, housing 12 may have multiple parts. For example, housing 12 may have upper portion 12A and lower portion 12B. Upper portion 12A may be coupled to lower portion 12B using a hinge that allows portion 12A to rotate about rotational axis 16 relative to portion 12B. A keyboard such as keyboard 18 and a touch pad such as touch pad 20 may be mounted in housing portion 12B.

Figure 2:
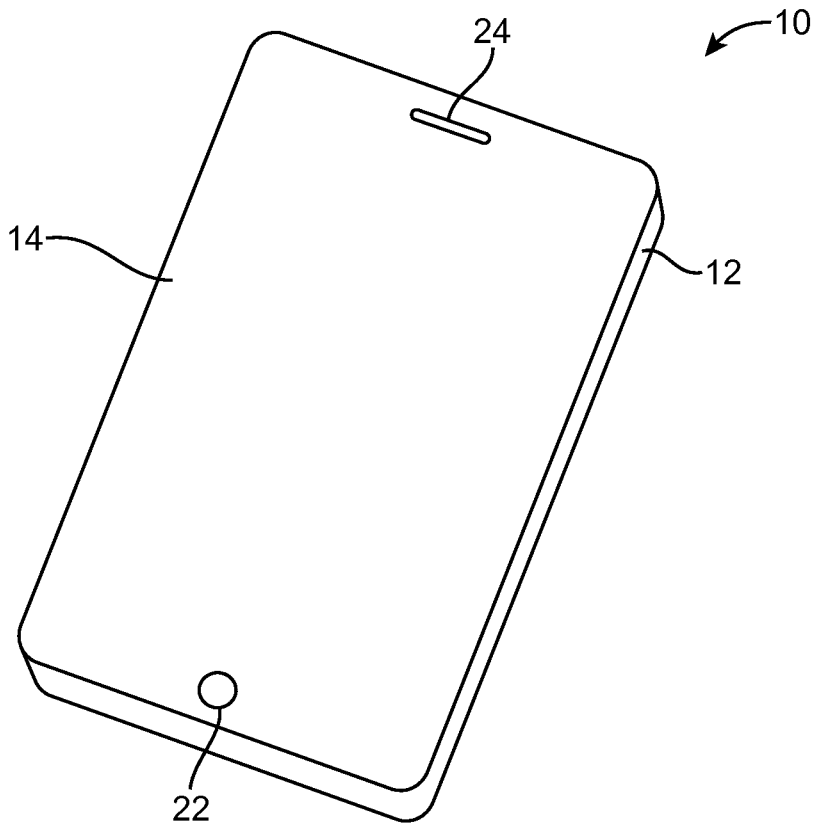
FIG. 2 is a diagram of an illustrative electronic device such as a cellular telephone or other handheld device having a calibrated display in accordance with an embodiment of the present invention.

In the example of FIG. 2, device 10 has been implemented using a housing that is sufficiently small to fit within a user's hand (e.g., device 10 of FIG. 2 may be a handheld electronic device such as a cellular telephone). As show in FIG. 2, device 10 may include a display such as display 14 mounted on the front of housing 12. Display 14 may be substantially filled with active display pixels or may have an active portion and an inactive portion. Display 14 may have openings (e.g., openings in the inactive or active portions of display 14) such as an opening to accommodate button 22 and an opening to accommodate speaker port 24.

Figure 3:
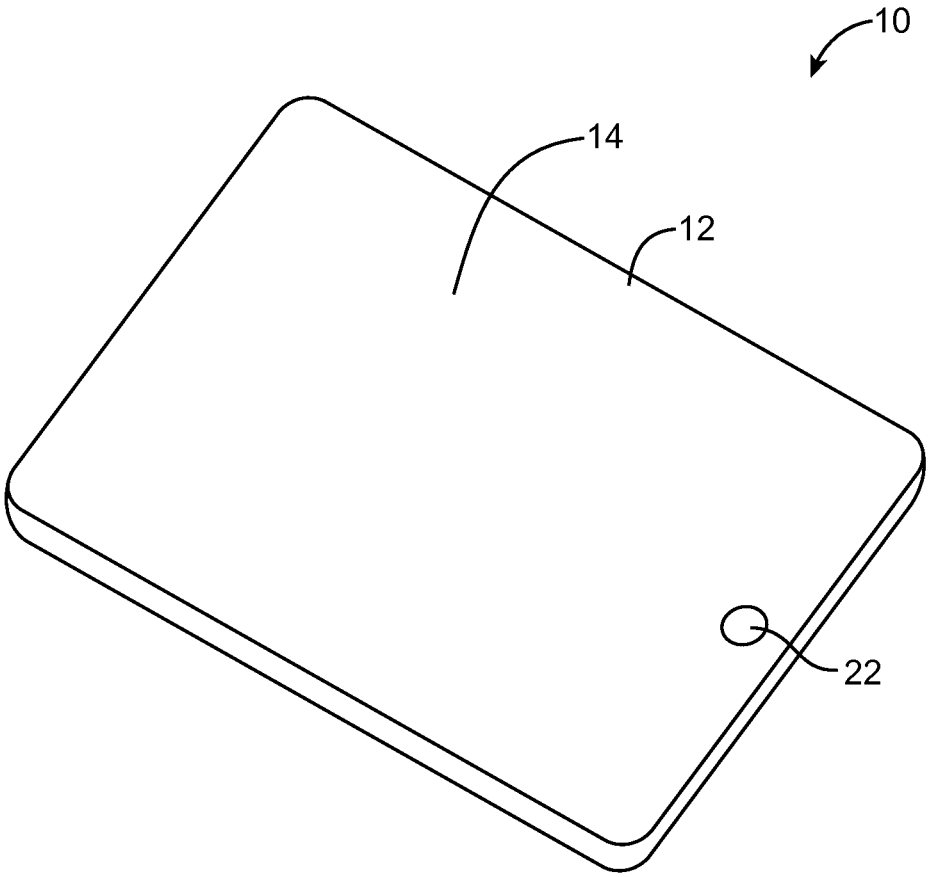
FIG. 3 is a diagram of an illustrative electronic device such as a tablet computer having a calibrated display in accordance with an embodiment of the present invention.

FIG. 3 is a perspective view of electronic device 10 in a configuration in which electronic device 10 has been implemented in the form of a tablet computer. As shown in FIG. 3, display 14 may be mounted on the upper (front) surface of housing 12. An opening may be formed in display 14 to accommodate button 22.

Figure 4:
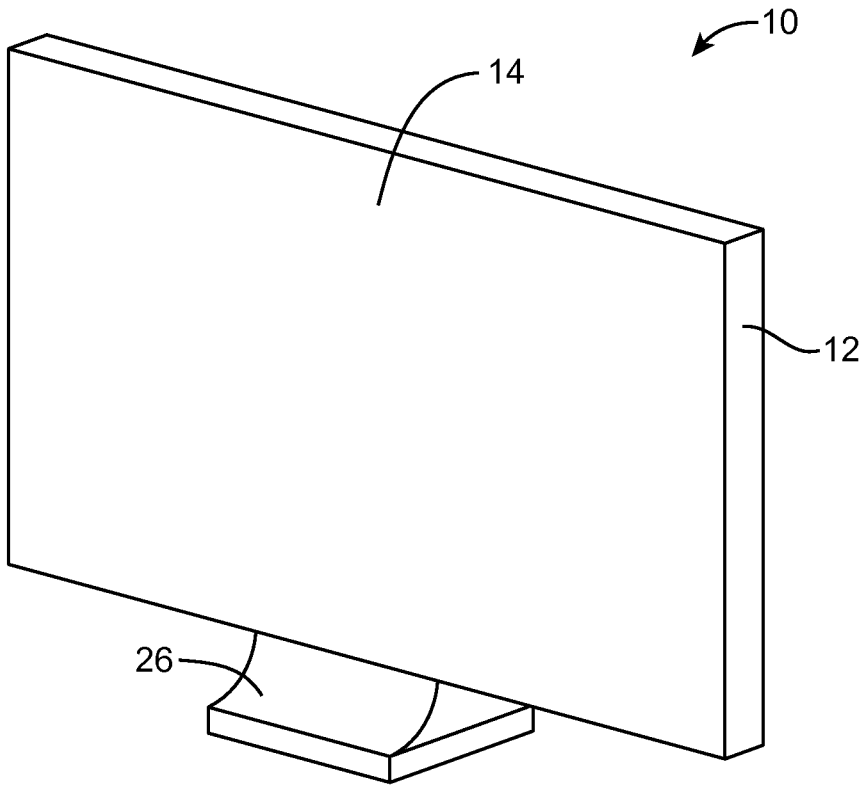
FIG. 4 is a diagram of an illustrative electronic device such as a computer monitor with a built-in computer having a calibrated display in accordance with an embodiment of the present invention.

FIG. 4 is a perspective view of electronic device 10 in a configuration in which electronic device 10 has been implemented in the form of a computer integrated into a computer monitor. As shown in FIG. 4, display 14 may be mounted on a front surface of housing 12. Stand 26 may be used to support housing 12.

Figure 5:
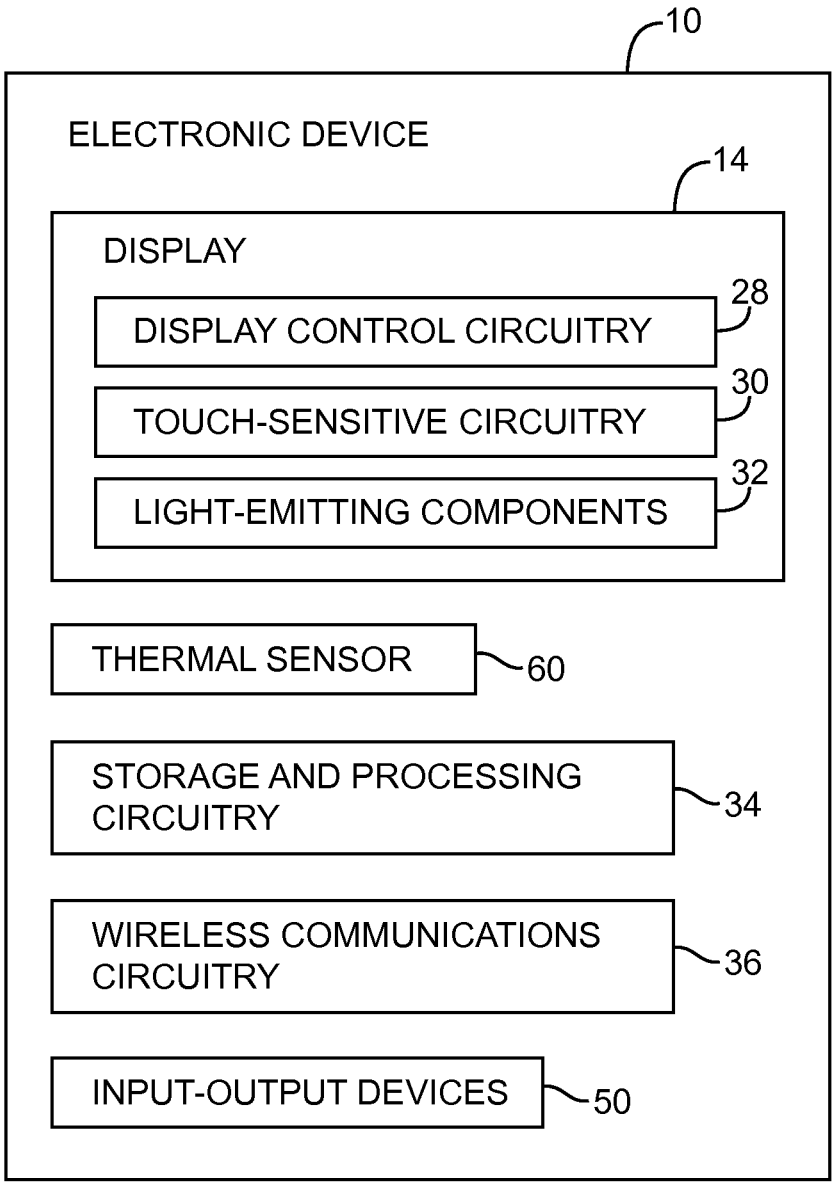
FIG. 5 is a schematic diagram of an illustrative electronic device having a calibrated display in accordance with an embodiment of the present invention.

A schematic diagram of electronic device 10 is shown in FIG. 5. As shown in FIG. 5, electronic device 10 may include a display such as display 14. Display 14 may include light-emitting components 32, touch-sensitive circuitry 30, display control circuitry 28 for operating light-emitting components 32, and other display components.

Light-emitting components 32 may include display pixels formed from reflective components, liquid crystal display (LCD) components, organic light-emitting diode (OLED) components, or other suitable display pixel structures. To provide display 14 with the ability to display color images, light-emitting components 32 may include display pixels having color filter elements. Each color filter element may be used to impart color to the light associated with a respective display pixel in the pixel array of display 14.

Display touch circuitry such as touch-sensitive circuitry 30 may include capacitive touch electrodes (e.g., indium tin oxide electrodes or other suitable transparent electrodes) or other touch sensor components (e.g., resistive touch technologies, acoustic touch technologies, touch sensor arrangements using light sensors, force sensors, etc.). Display 14 may be a touch screen that incorporates display touch circuitry 30 or may be a display that is not touch-sensitive.

Display control circuitry 28 may include a graphics controller (sometimes referred to as a video card or video adapter) that may be used to provide video data and control signals to display 14. Video data may include text, graphics, images, moving video content, or other content to be presented on display 14.

Display control circuitry 28 may also include display driver circuitry. Display driver circuitry in circuitry 28 may be implemented using one or more integrated circuits (ICs) and may sometimes be referred to as a driver IC, display driver integrated circuit, or display driver. Display driver circuitry may include, for example, timing controller (TCON) circuitry such as a TCON integrated circuit. If desired, display driver circuitry may be mounted on an edge of a thin-film-transistor substrate layer in display 14 (as an example). Display control circuitry 28 may be coupled to additional circuitry in device 10 such as storage and processing circuitry 34.

Device 10 may include a thermal sensor such as thermal sensor 60. Thermal sensor 60 may be an internal sensor in device 10 configured to gather temperature data from device 10 or may be external sensor such as an infrared thermal gun or other suitable type of temperature sensor. Thermal sensor 60 may be used to measure display temperature, display cover glass temperature (e.g., the temperature associated with a cover glass layer that covers display 14), backlight temperature (e.g., a the temperature associated with light-emitting diodes that provide backlight for display 14), internal component temperature (e.g., the temperature associated with an internal component in device 10 such as a central processing unit (CPU) or other component), etc. Thermal sensor 60 may be configured to measure the temperature at different locations on display 14 (e.g., one, three, five, seven, less than seven, or more than seven locations). Temperature information gathered by sensor 60 may sometimes be referred to herein as "display temperature" or "device temperature."

Control circuitry such as storage and processing circuitry 34 in device 10 may include microprocessors, microcontrollers, digital signal processor integrated circuits, application-specific integrated circuits, and other processing circuitry. Volatile and non-volatile memory circuits such as random-access memory, read-only memory, hard disk drive storage, solid state drives, and other storage circuitry may also be included in circuitry 34. Display calibration information may be stored using circuitry 34 or may be stored using display control circuitry 28 or other circuitry associated with display 14.

Circuitry 34 may use wireless communications circuitry 36 and/or input-output devices 50 to obtain user input and to provide output to a user. Input-output devices 50 may include speakers, microphones, sensors, buttons, keyboards, displays, touch sensors, and other components for receiving input and supplying output. Wireless communications circuitry 36 may include wireless local area network transceiver circuitry, cellular telephone network transceiver circuitry, and other components for wireless communication.

Display calibration information such as color-specific and temperature-specific adjustment values may be loaded onto device 10 during manufacturing. The stored adjustment values may be used to adjust display colors in order to compensate for changes in display temperature. Adjustment values may be stored in any suitable location in electronic device 10. For example, adjustment values may be stored in storage and processing circuitry 34 or in display control circuitry 28.

In one suitable embodiment, a display TCON integrated circuit in circuitry 28 may receive input RGB values from storage and processing circuitry 34 and may receive display temperature information from thermal sensor 60. Based on the input RGB values and the temperature information, the TCON integrated circuit may determine a color-specific and temperature-specific adjustment value for each input RGB value. The TCON integrated circuit may apply the adjustment values to either the input RGB values or to the gain control of the RGB channels. The adjustment values may change the display colors such that the display colors appear as the target color.

Figure 6:
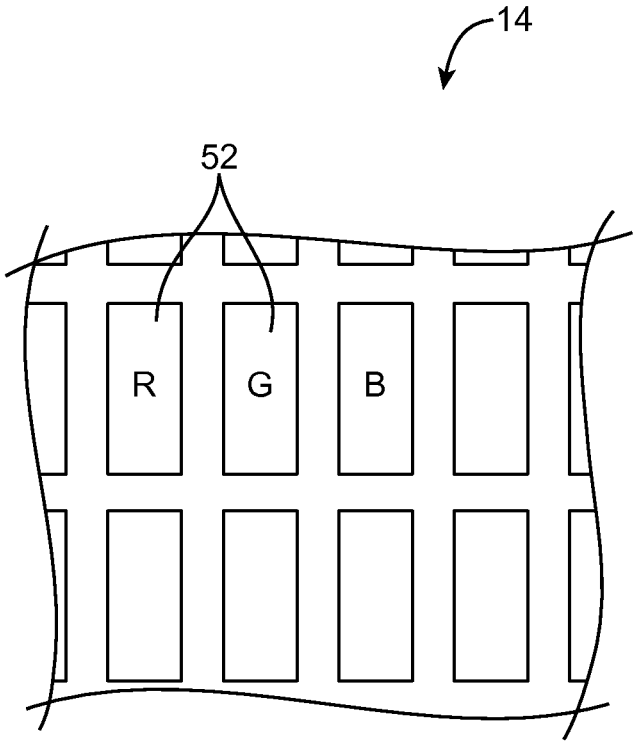
FIG. 6 is a diagram of a portion of an illustrative display showing how colored display pixels may be arranged in rows and columns in accordance with an embodiment of the present invention.

A portion of an illustrative array of display pixels that may be used in display 14 is shown in FIG. 6. As shown in FIG. 6, display 14 may have a pixel array with rows and columns of pixels such as display pixels 52. There may be tens, hundreds, or thousands of rows and columns of display pixels 52. Each pixel 52 may, if desired, be a color pixel such as a red (R) pixel, a green (G) pixel, a blue (B) pixel or a pixel of another color. Red pixels R, for example, may include a red color filter element over a light generating element (e.g., a liquid crystal pixel element or an OLED pixel element) that absorbs and/or reflects non-red light while passing red light. This is, however, merely illustrative. Pixels 52 may include any suitable structures for generating light of a given color.

Pixels 52 may include pixels of any suitable color. For example, pixels 52 may include a pattern of cyan, magenta, and yellow pixels, or may include any other suitable pattern of colors. Arrangements in which pixels 52 include a pattern of red, green, and blue pixels is sometimes described herein as an example.

Display control circuitry 28 (FIG. 5) such as a display driver integrated circuit and, if desired, associated thin-film transistor circuitry formed on a display substrate layer may be used to produce signals such as data signals and gate line signals (e.g., on data lines and gate lines respectively in display 14) for operating pixels 52 (e.g., turning pixels 52 on and/or off and/or adjusting the intensity of pixels 52). During operation, display control circuitry 28 may control the values of the data signals and gate signals to control the light intensity associated with each of the display pixels and to thereby display images on display 14.

Display control circuitry 28 may be used to convert input RGB values (sometimes referred to as digital display control values) for each display pixel 52 into analog display signals for controlling the brightness of each pixel. Control circuitry such as storage and processing circuitry 34 may provide input RGB values (commonly integers with values ranging from 0 to 255) corresponding to the desired pixel intensity of each pixel to display control circuitry 28. For example, a digital display control value of 0 may result in an "off" pixel, whereas a digital display control value of 255 may result in a pixel operating at a maximum available power.

It should be appreciated that these are examples of 24-bit color in which each color channel has eight bits dedicated to it. Alternative embodiments may employ greater or fewer bits per color channel. For example, display 14 may support 18-bit color in which each color has six bits dedicated to it. With this type of configuration, input RGB values may be a set of integers ranging from 0 to 64. Arrangements in which display 14 supports 24-bit color are sometimes described herein as an example.

Display control circuitry 28 may be used to concurrently operate pixels 52 of different colors in order to generate light having a color that is a mixture of, for example, primary colors red, green, and blue. As examples, operating red pixels R and blue pixels B at equal intensities may produce light that appears violet, operating red pixels R and green pixels G at equal intensities may generate light that appears yellow, operating red pixels R and green pixels G at maximum intensity while operating blue pixels B at half of maximum intensity may generate light that appears "yellowish," operating red pixels R, green pixels G, and blue pixels B simultaneously at maximum intensity may generate light that appears white, etc.

However, due to variations in display temperature, some internal parameters of the display may change, which may in turn affect the luminance and the chromaticity of the displayed color, even if the RGB input signal is not changed. For example, displayed colors may vary with temperature.

Figure 7:
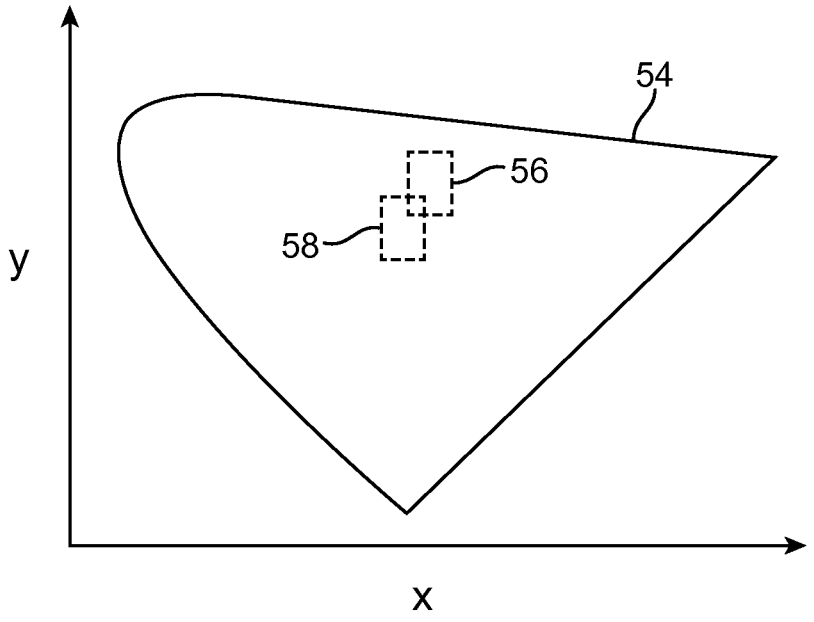
FIG. 7 is a chromaticity diagram showing how changes in display temperature may cause colors to shift within a color space.

A chromaticity diagram illustrating this type of temperature induced color shift is shown in FIG. 7. The chromaticity diagram of FIG. 7 illustrates a two-dimensional projection of a three-dimensional color space. The color generated by a display such as display 14 may be represented by chromaticity values x and y. The chromaticity values may be computed by transforming, for example, three color intensities (e.g., intensities of colored light emitted by a display) such as intensities of red, green, and blue light into three tristimulus values X, Y, and Z and normalizing the first two tristimulus values X and Y (e.g., by computing $x=X/(X+Y+Z)$ and $y=Y/(X+Y+Z)$ to obtain normalized x and y values). Transforming color intensities into tristimulus values may be performed using transformations defined by the International Commission on Illumination (CIE) or using any other suitable color transformation for computing tristimulus values.

Any color generated by a display may therefore be represented by a point (e.g., by chromaticity values x and y) on a chromaticity diagram such as the diagram shown in FIG. 7. Bounded region 54 of FIG. 7 represents the limits of visible light that may be perceived by humans (i.e., the total available color space). The colors that may be generated by a display are contained within a subregion of bounded region 54.

Changing display temperatures may have a noticeable impact on colors being displayed on the display. At an initial power-on state, a display may have an initial white point that lies within bounded region 56. The initial white point of the display within bounded region 56 may appear on the display as a yellowish color. As time passes, the physical display temperature may increase to a stable value. The increase in display temperature may induce a corresponding change in the display white point. For example, as the display warms up to a stable operating temperature, the display white point may shift from bounded region 56 to bounded region 58. A white point that lies within bounded region 58 may appear accurately rendered (e.g., may appear as a neutral white). If a display continues to warm up beyond a stable operating temperature, the display white point may appear slightly blue. It should be noted that the actual objective display white point may shift from region 56 to region 58 even when the RGB input values do not change. Other colors may experience shifts within bounded region 54 as a result of changing display temperature.

Figure 8:
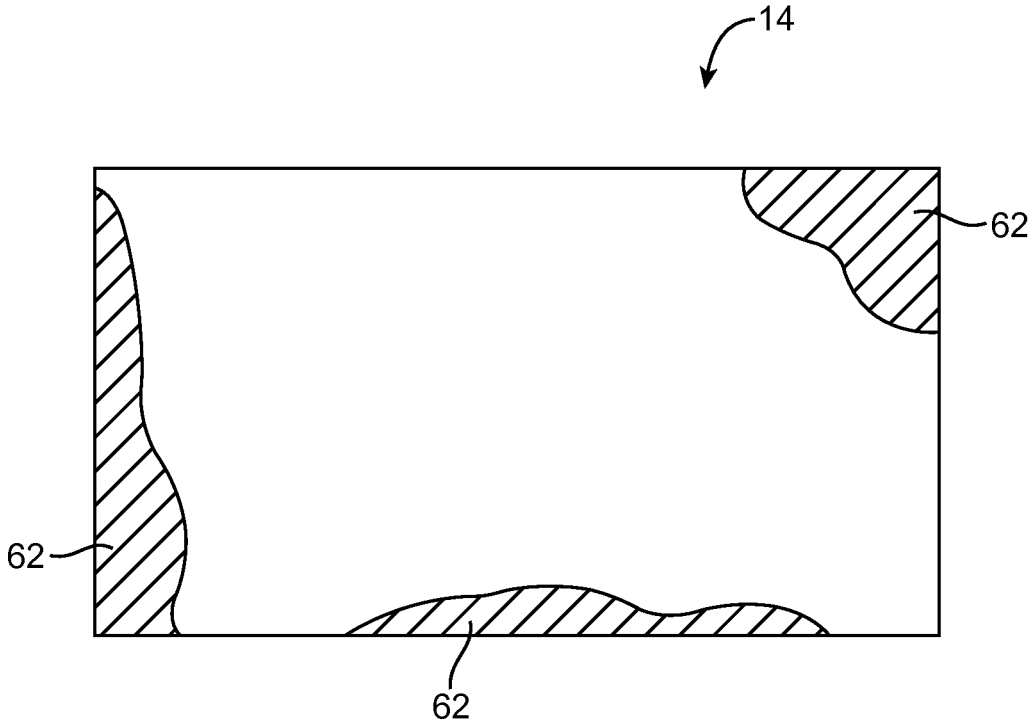
FIG. 8 is an illustrative display showing how some areas of the display may experience higher temperature gradients than other portions of the display during operation of the display in accordance with an embodiment of the present invention.

Displays are sometimes calibrated to minimize temperature induced white point shifts. Conventional methods involve applying adjustment values to RGB input values based on a temperature measured at the center of the display. However, displays often exhibit local variations in temperature. For example, as shown in FIG. 8, regions such as regions 62 of display 14 may experience greater variation in temperature compared to the center of display 14. Regions such as regions 62 may, for example, include cold spots and hotspots (e.g., hotspots near a graphics processing unit, hotspots near light-emitting diodes, etc.).

A hotspot may be a location on display 14 that tends to experience higher temperatures relative to other locations on display 14, whereas a cold spot may be a location on display 14 that tends to experience lower temperatures relative to other locations on display 14.

The locations and/or number of hotspots or cold spots may change as the operating conditions of device 10 change. For example, temperature variation across display 14 may be more significant when the display backlight is powered high than when the display backlight is powered low.

Adjustment values that are determined based on a temperature measured at the center of a display may be inadequate in correcting colors in regions that experience localized variations in temperature (e.g., regions such as regions 62 of FIG. 8).

To overcome this type of temperature induced color distortion, adjustment values may be determined based on temperatures at specific locations on the display. For example, the adjustment value applied to incoming pixel values for a given pixel in one of regions 62 of display 14 may be determined based on the display temperature at the given pixel in region 62.

If desired, adjustment factors may be determined for a number of different colors. For example, a set of adjustment values may be derived for white, a set of adjustment values may be derived for yellowish green, a set of adjustment values may be derived for bluish red, a set of adjustment values may be derived for magenta, etc.

Each set of color-specific adjustment factors may be used to adjust RGB input values to compensate for local temperature changes in the display. The color-specific adjustment values may be used to ensure that a given display color remains at the "target color" even as the display temperature changes. A target color may refer to a display color with a desired luminance and chromaticity.

Figure 9:
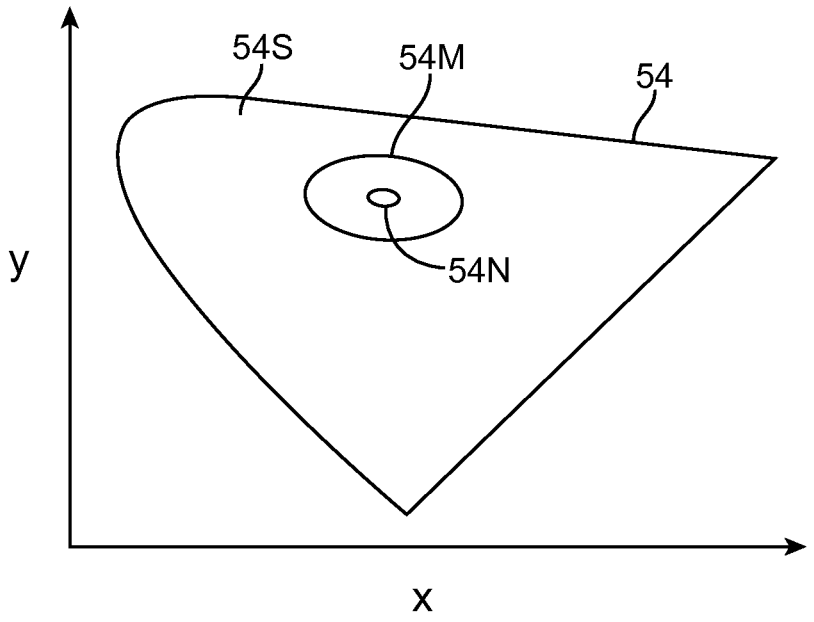
FIG. 9 is a chromaticity diagram showing illustrative colors for which tables of adjustment values may be derived in accordance with an embodiment of the present invention.

A chromaticity diagram showing illustrative colors for which adjustment values may be derived is shown in FIG. 9. Saturated colors may be included in a subregion such as subregion 54S of bounded region 54. Subregion 54S may include saturated primary colors (e.g., saturated red, saturated green, and saturated blue) and saturated secondary colors (e.g., saturated cyan, saturated magenta, and saturated yellow). Subregion 54N may include neutral colors. Neutral colors may include, for example, colors having equal intensities of red, green, and blue. Colors such as white and gray (e.g., different shades of gray) may be included in region 54N.

A third subregion such as subregion 54M may include mid-tone colors. Mid-tone colors in subregion 54M may lie between the saturated colors of region 54S and the neutral colors of region 54N. The human eye may be more sensitive to color shifts in mid-tone colors in a display than to color shifts in saturated colors. If desired, color-specific adjustment values may be derived for a set of representative colors that lie in regions 50M and 50N to compensate for temperature induced color shifts in these regions of the color space. In general, color-specific adjustment values may be derived for any suitable color or set of colors. Choosing a set of colors that lie in region 50M and/or 50N is merely illustrative.

Figure 10:
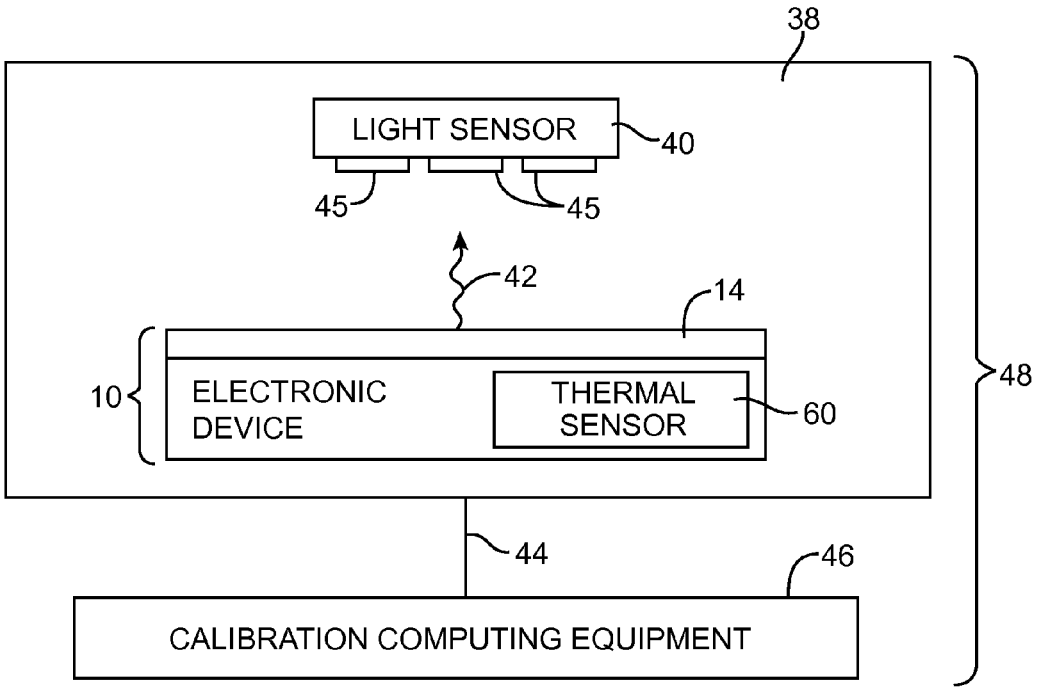
FIG. 10 is a diagram of an illustrative calibration system for performing display calibration including calibration computing equipment and a test chamber having a light sensor in accordance with an embodiment of the present invention.

FIG. 10 is a diagram of an illustrative calibration system that may be used to perform temperature adaptive display calibration for a display such as display 14 of device 10. As shown in FIG. 10, calibration system 48 may include calibration computing equipment 46 that is coupled to test apparatus such as test chamber 38. Calibration computing equipment 46 may include one or more computers, one or more databases, one or more displays, one or more technician interface devices (e.g., keyboards, touch-screens, joysticks, buttons, switches, etc.) for technician control of calibration computing equipment 46, communications components or other suitable calibration computing equipment.

Calibration computing equipment 46 may be coupled to test chamber 38 using a wired or wireless communications path such as path 44.

Test chamber 38 may include a light sensor such as light sensor 40. Light sensor 40 may include one or more light-sensitive components such as light-sensitive components 45 for gathering display light 42 emitted by display 14 during calibration operations. Light-sensitive components 45 may include, for example, colorimetric light-sensitive components and/or spectrophotometric light-sensitive components that are configured to gather colored light from display 14.

Light sensor 40 may, for example, be a colorimeter having one or more light-sensitive components 45 corresponding to each set of colored pixels in display 14. For example, a display having red, green, and blue display pixels may be calibrated using a light sensor having corresponding red, green, and blue light-sensitive components 45. This is, however, merely illustrative. A display may include display pixels for emitting colors other than red, green, and blue, and light sensor 40 may include light-sensitive components 45 sensitive to colors other than red, green, and blue, may include white light sensors, or may include spectroscopic sensors.

Light sensor 40 may, for example, be an infrared camera (e.g., an infrared thermographic camera) configured to capture infrared images of display 14. Infrared imaging may be used to measure the two-dimensional temperature distributions of display 14 and to record the temperature gradients of display 14. Determining the temperature gradients of display 14 may allow for a more accurate estimation of the temperature at an individual pixel. For example, display temperature gradient information gathered by light sensor 40 may be stored in device 10. Display control circuitry 28 may use the temperature gradient information to interpolate temperatures at individual pixels based on temperatures measured by thermal sensor 60.

Test chamber 38 may, if desired, be a light-tight chamber that prevents outside light (e.g., ambient light in a testing facility) from reaching light sensor 40 during calibration operations.

During calibration operations, calibration computing equipment 46 may gather information from device 10 such as temperature information and display performance information. Calibration computing equipment 46 may use the temperature information and display performance information gathered from device 10 to generate temperature adaptive display calibration parameters for device 10.

Temperature information may be gathered from device 10 using thermal sensor 60. Thermal sensor 60 may, for example, be an internal sensor in device 10 (as shown in FIG. 10). Thermal sensor 60 may be used to measure any suitable temperature associated with device 10 (e.g., display temperature, display cover glass temperature, backlight temperature, internal component temperature, etc.).

Thermal sensor 60 may be configured to measure the temperature at different locations on display 14. For example, thermal sensor 60 may be configured to measure the temperature at critical locations on display 14 such as corners, edges, hotspots, cold spots, etc.

Temperature information gathered by thermal sensor 60 and display performance information gathered by light sensor 40 may be provided to calibration computing equipment 46 over path 44. Display performance information may include measured luminance and chromaticity values. For example, luminance (Y) and chromaticity (x,y) of light emitted by display 14 may be measured for a number of different colors (e.g., a number of different input RGB values). These measurements may be repeated for each color at a number of different temperatures.

During calibration operations, device 10 may be placed into test chamber 38 (e.g., by a technician or by a robotic member). Calibration computing equipment 46 may be used to operate device 10 and light sensor 40 during calibration operations. For example, calibration computing equipment 46 may issue a command (e.g., by transmitting a signal over path 44) to device 10 to operate some or all pixels of display 14. While device 10 is operating the pixels of display 14, calibration computing equipment 46 may operate light sensor 40 to gather display performance information from display 14 corresponding to the light 42 emitted by display 14. When it is desired to read out one or more temperatures associated with device 10, calibration computing equipment 46 may issue a command to device 10 to supply a temperature reading from thermal sensor 60 to calibration computing equipment 46 over path 44. A temperature reading may include the current display temperature at one or more locations on the display.

Calibration computing equipment 46 may determine a set of color-specific adjustment values for each color in a set of predetermined colors. The adjustment value may include three values: an adjustment value for the red channel, an adjustment value for the green channel, and an adjustment value for the blue channel. For explanatory purposes, although an adjustment value may include three values, it may sometimes be referred to herein as "adjustment values." Additionally, the terms "RGB channel gain" and "input RGB values" may sometimes be referred to herein as "RGB values."

Each set of adjustment values may be stored in an RGB adjustment value table. The RGB adjustment value tables may be stored in device 10. During operation of display 14, the color-specific adjustment values may be applied to the RGB values so that the displayed colors each appear as the associated target color even though the display may be at different temperatures.

Adjustment values may be derived based on display performance information gathered during calibration operations. For example, calibration computing equipment 46 of FIG. 10 may determine which RGB input values produce a given target color at a given temperature. The RGB values that produce a given target color at a number of different temperatures may be stored in an RGB table such as RGB table 62 of FIG. 11, RGB table 64 of FIG. 12, and RGB table 66 of FIG. 13. RGB tables of this type may be used to determine a set of adjustment values for any desired target color.

Table 62 of FIG. 11 may be used to determine adjustment values optimized for neutral colors such as white and different shades of gray. Neutral colors may be defined by an R:G:B ratio of 1:1:1 (i.e., equal intensities of red, green, and blue light). As shown in FIG. 11, table 62 includes RGB values RGB1 through RGBm, where RGB1 through RGBm are the RGB values that may produce a neutral color corresponding to the target neutral color (e.g., the target white point) at the temperature T1 through Tm, respectively. The RGB1 through RGBm values may be used to compute the adjustment values R1 through Rm for the red component, G1 through Gm for the green component, and B1 through Bm for the blue component for the temperature T1 through Tm, respectively.

Table 64 of FIG. 12 may be used to determine adjustment values optimized for yellowish colors. Yellowish colors may be defined by an R:G:B ratio of 2:2:1 (i.e., red and green light each have twice the intensity of blue light). As shown in FIG. 12, table 64 includes RGB values RGB1' through RGBm', where RGB1' through RGBm' are the RGB values that may produce a yellowish color corresponding to the target yellowish color at the temperature T1 through Tm, respectively. The RGB1' through RGBm' values may be used to compute the adjustment values R1' through Rm' for the red component, G1' through Gm' for the green component, and B1' through Bm' for the blue component for the temperature T1 through Tm, respectively.

Table 66 of FIG. 13 may be used to determine adjustment values optimized for greenish blue colors. Greenish blue colors may be defined by an R:G:B ratio of 1:2:3 (i.e., green light has twice the intensity of red light, and blue light has three times the intensity of red light). As shown in FIG. 13, table 66 includes RGB values RGB1" through RGBm", where RGB1" through RGBm" are the RGB values that may produce a greenish blue color corresponding to the target greenish blue color at the temperature T1 through Tm, respectively. The RGB1" through RGBm" values may be used to compute the adjustment values R1" through Rm" for the red component, G1" through Gm" for the green component, and B1" through Bm" for the blue component for the temperature T1 through Tm, respectively.

Each adjustment value may correspond to a single temperature and may be indexed in the RGB adjustment value table by the corresponding temperature. The adjustment values may be determined for each RGB channel at a specific temperature. The adjustment value for an arbitrary temperature T may be computed using the following ratio:

$$R_A = \frac{R_T}{R_C} \qquad G_A = \frac{G_T}{G_C} \qquad B_A = \frac{B_T}{B_C} \tag{1}$$

where $R_A$, $G_A$, and $B_A$ are the respective adjustment values for each RGB channel at the arbitrary temperature T; $R_T$, $G_T$, and $B_T$ are the respective RGB values interpolated from two RGB sets from the RGB table corresponding to the temperatures T1, T2 that define the smallest temperature interval containing the temperature T; and $R_C$, $G_C$, and $B_C$ are the respective RGB values corresponding to the target color at a stable operating display temperature.

The examples described in connection with FIGS. 11, 12, and 13 are merely illustrative. In general, a table of color-specific adjustment values may be derived for any desired color (i.e., for any desired R:G:B ratio). For example, a table of color-specific adjustment values may be derived for ten different colors (i.e., ten different R:G:B ratios), more than ten different colors, less than ten different colors, etc. If desired, a table of color-specific adjustment values may be derived only for neutral colors such as white and gray. The colors described in connection with FIGS. 11, 12, and 13 are merely illustrative.

The RGB tables described above in connection with FIGS. 11, 12, and 13 may be derived from sets of color gamuts that are constructed during calibration operations. A color gamut may be constructed in a number of ways. The color gamut may represent the range of possible colors that a display may produce for a given temperature.

In one suitable arrangement, the color gamut may be constructed by employing a look-up table based model and the color gamut may be an empirical model. With this type of arrangement, a set of input RGB values may be predetermined. The selection of the set of predetermined RGB values may be based on the number of desired values for each color. For example, six values ranging from 0 to 255 may be chosen for the red component, six values ranging from 0 to 255 may be chosen for the green component and six values ranging from 0 to 255 may be chosen for the blue component. For every combination of the six values for each of the three components, a luminance (Y) and a chromaticity (x,y) may be measured. These measurements may be repeated for a number of different temperatures.

For constructing a color gamut at a temperature T1, for example, measurements corresponding to a color model and at the temperature T1 may be taken. The measurements at each of the temperatures T1 through Tm may show the variation of luminance or the variation of a target color in the form of the correlated color temperature value (as an example).

Returning to constructing a color gamut, a predetermined set of RGB values may be defined. In this example, at each operating temperature T1 through Tm, the luminance (Y) and the chromaticity (x,y) may be measured for each of the RGB values in the predetermined set of RGB values. If the matrix color model is used, four color measurements for pure red, pure green, pure blue and pure white, at each temperature T1, through Tm, may be used for the display. For example, pure red may be produced by input RGB values of 255, 0, 0, pure green may be produced by input RGB values of 0, 255, 0, pure blue may be produced by input RGB values of 0, 0, 255 and pure white may be produced by input RGB values of 255, 255, 255.

If a look-up table model is used with 216 samples (6×6×6=216), the measurements may be taken of luminance (Y) and chromaticity (x,y) for 216 predetermined RGB values. For example, at a temperature T1, a luminance and chromaticity measurement may be taken for each of the 216 predetermined RGB values. Similarly, for a temperature T2, another luminance and chromaticity measurement may be taken for each of the 216 predetermined RGB values and so on. The 216 RGB values is provided for explanatory purposes only. If desired, the number of samples per each component may be increased (for example, using seven or more values for each of the individual RGB values), thus increasing the accuracy of the empirical model.

Each color gamut CG1 through CGm may be defined at each temperature T1 through Tm, respectively. The RGB table may be calculated once the target luminance Y and target chromaticity (x,y) values are set. The calculation of the RGB table may be performed line by line. Each line in the table may correspond to a respective temperature T1 through Tm such that the RGB table has m lines. For each line k in the RGB table, the RGB values may be computed as follows. For temperature Tk, the target luminance and white point values may correspond to a unique color in the color gamut CGk. The unique color may be produced by a certain RGB value, RGBk. Resolving the RGBk color for a given target color and color gamut may depend on the color model that is used for the display. For example, if the matrix model is used, the following equations are used to compute RGB from Yxy of the target:

$$X = \frac{Y}{y}x,\ Z = \frac{Y}{y}(1 - x - y)$$

$$[r_{linear} g_{linear} b_{linear}]^T = M^{-1i}[XYZ]^T$$

$$R = rTRC - 1[r_{linear}]$$

$$G = gTRC - 1[g_{linear}]$$

$$B = bTRC - 1[b_{linear}]$$

where $$M = \begin{bmatrix} X_r & X_g & X_b \\ Y_r & Y_g & Y_b \\ Z_r & Z_g & Z_b \end{bmatrix}$$

wherein rTRC corresponds to the red tone reproduction curve, gTRC corresponds to the green tone reproduction curve, and bTRC corresponds to the blue tone reproduction curve.

If the look-up table model is used, the calculation of the RGB with a defined color gamut as a table of (RGB Yxy) sets may be based on tetrahedral decomposition and tetrahedral interpolation, which are known to one of ordinary skill in the art.

The exemplary operating temperatures for constructing a color model may be selected at intervals sufficiently close together such that the color may be adjusted at small enough temperature intervals that there may be no perceptible shift in color. A color model including a luminance measurement Y and a chromaticity measurement (x,y) for each of the predetermined RGB values may be constructed for each of the set of operating temperatures. For example, at an operating temperature T, a color model generated or used by the present embodiment may include a luminance measurement Y and a chromaticity measurement (x,y) for each predetermined RGB value. For example, a color model may contain the following information:

TABLE 1

| | | | | | |
|---|---|---|---|---|---|
| T1 | R1 | G1 | B1 | Y1 | (x, y)1 |
| T1 | R2 | G2 | B2 | Y2 | (x, y)2 |
| | | | ... | | |
| T1 | Rn | Gn | Bn | Yn | (x, y)n |

where the measurements (Yxy)1 through (Yxy)n correspond to the temperature T1. Accordingly, multiple luminance and chromaticity values (Y and (x,y), respectively) may be measured for a variety of predetermined RGB values R1,G1,B1 to Rn,Gn,Bn at a single operating temperature T1. Also, n is the number of luminance and chromaticity measurements taken at each operating temperature.

For every selected operating temperature T1 through Tm, color gamuts CG1 through CGm may be constructed for each corresponding temperature. The construction of the color gamuts may be based on the color model that employs the measurements at each temperature T1 through Tm. The measurements taken at each of the temperatures T1 through Tm may be selected to cover the range from approximately the cold start-up temperature of the display to the stable operating temperature of the display. In one example, the last or stable operating temperature may be the display temperature after the display has been on for a predetermined period of time. Generally, the color table for the last temperature may be represented as:

TABLE 2

| | | | | | |
|---|---|---|---|---|---|
| Tm | R1 | G1 | B1 | Y1 | (x, y)1 |
| Tm | R2 | G2 | B2 | Y2 | (x, y)2 |
| | | | ... | | |
| Tm | Rn | Gn | Bn | Yn | (x, y)n |

Thus, m color gamuts CG1 through CGm may be constructed using the temperatures, predetermined RGB values, luminance measurements and chromaticity measurements and the color model at each temperature T1 through Tm. The m color models may, for example, take the form of tables 1 and 2, where table 1 corresponds to color model 1 and where table 2 corresponds to color model m.

In another suitable embodiment, a color model may be constructed using a matrix model. The matrix model may, for example, employ measurements of the following colors: the display red, green, blue and white colors, and a set of intermediate gray colors between black and white for tone reproduction curve estimation. For this embodiment, 6 intermediate gray colors may be used. The luminance measurements Y and the chromaticity measurements (x,y) may be taken for a predetermined set of RGB values specified by the following n=4+6 combinations, and the (Yxy)j,k may represent the measurements for the color model k at temperature Tk, k=1 through m and for the combination j, where j may be a natural number from n=1 through n=10.

Color Model 1

TABLE 3

| | | | | | |
|---|---|---|---|---|---|
| T1 | 255 | 0 | 0 | Y1,1 | (x, y)1,1 |
| T1 | 0 | 255 | 0 | Y2,1 | (x, y)2,1 |
| T1 | 0 | 0 | 255 | Y3,1 | (x, y)3,1 |
| T1 | 255 | 255 | 255 | Y4,1 | (x, y)4,1 |
| T1 | 204 | 204 | 204 | Y5,1 | (x, y)5,1 |
| T1 | 153 | 153 | 153 | Y6,1 | (x, y)6,1 |
| | | | ... | | |
| T1 | 0 | 0 | 0 | Y10,1 | (x, y)10,1 |

Color Model m

TABLE 4

| | | | | | |
|---|---|---|---|---|---|
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |
| Tm | 204 | 204 | 204 | Y5, m | (x, y)5, m |
| Tm | 153 | 153 | 153 | Y6, m | (x, y)6, m |
| | | | ... | | |
| Tm | 0 | 0 | 0 | Y10, m | (x, y)10, m |

The tone reproduction curve in the matrix model may be determined at each temperature T1 through Tm from the measurements Y5, k through Y10, k using an interpolation method familiar to one of ordinary skill in the art. In this embodiment, linear interpolation may be employed (if desired).

In another embodiment, a color model may be constructed using a matrix model where the tone reproduction curves may be independent of the temperature and estimated before the color measurements are taken at the temperature T1 through Tm. The measurement of the intermediate gray colors may be done at the initial cold or warmed up stable display temperature. The curves may be derived through interpolation one time and may be used for each color model at temperature T1 through Tm. For this embodiment, the matrix model may employ the measurements of the following colors: the device red, green, blue and white colors. The luminance measurements Y and the chromaticity measurements (x,y) may be taken for a predetermined set of RGB values specified by the following n=4 combinations. Additionally, the (Yxy)j,k values may represent the measurement for the color model k at temperature Tk, k=1 through m and for the combination j, where j may be a natural number from 1 through n=10.

Color Model 1

TABLE 5

| | | | | | |
|---|---|---|---|---|---|
| T1 | 255 | 0 | 0 | Y1, 1 | (x, y)1, 1 |
| T1 | 0 | 255 | 0 | Y2, 1 | (x, y)2, 1 |
| T1 | 0 | 0 | 255 | Y3, 1 | (x, y)3, 1 |
| T1 | 255 | 255 | 255 | Y4, 1 | (x, y)4, 1 |

Color Model m

TABLE 6

| | | | | | |
|---|---|---|---|---|---|
| Tm | 255 | 0 | 0 | Y1, m | (x, y)1, m |
| Tm | 0 | 255 | 0 | Y2, m | (x, y)2, m |
| Tm | 0 | 0 | 255 | Y3, m | (x, y)3, m |
| Tm | 255 | 255 | 255 | Y4, m | (x, y)4, m |

In another embodiment, a color model may be constructed using a look-up table model. The luminance measurements Y and the chromaticity measurements (x,y) may be taken for a predetermined set of RGB values specified by the following n=6×6×6 combinations. Six intermediate values may be set for each R,G,B component, and the (Yxy)j,k may represent the measurement for the color model k at temperature Tk, k=1 through m and for the combination j, where j may be a natural number from 1 through n=216.

Color Model 1

TABLE 7

| | | | | | |
|---|---|---|---|---|---|
| T1 | 255 | 255 | 255 | Y1, 1 | (x, y)1, 1 |
| T1 | 255 | 255 | 204 | Y2, 1 | (x, y)2, 1 |
| T1 | 255 | 255 | 153 | Y3, 1 | (x, y)3, 1 |
| T1 | 255 | 255 | 102 | Y4, 1 | (x, y)4, 1 |
| | | | ... | | |
| T1 | 0 | 0 | 0 | Y216, 1 | (x, y)216, 1 |

Color Model m

TABLE 8

| | | | | | |
|---|---|---|---|---|---|
| Tm | 255 | 255 | 255 | Y1, m | (x, y)1, m |
| Tm | 255 | 255 | 204 | Y2, m | (x, y)2, m |
| Tm | 255 | 255 | 153 | Y3, m | (x, y)3, m |
| Tm | 255 | 255 | 102 | Y4, m | (x, y)4, m |
| | | | ... | | |
| Tm | 0 | 0 | 0 | Y216, m | (x, y)216, m |

If desired, a color-specific color model may be constructed for each target color. For example, color models for yellowish (R:G:B=2:2:1) may be constructed by taking luminance measurements Y and chromaticity measurements (x,y) for a predetermined set of RGB values having R:G:B ratios of 2:2:1. The m color models for yellowish colors may, for example, take the following form:

Color Model 1

TABLE 9

| | | | | | |
|---|---|---|---|---|---|
| T1 | 255 | 255 | 127 | Y1, 1 | (x, y)1, 1 |
| T1 | 221 | 221 | 110 | Y2, 1 | (x, y)2, 1 |
| T1 | 187 | 187 | 93 | Y3, 1 | (x, y)3, 1 |
| | | | ... | | |
| T1 | 17 | 17 | 8 | Y8, 1 | (x, y)8, 1 |

Color Model m

TABLE 10

| | | | | | |
|---|---|---|---|---|---|
| Tm | 255 | 255 | 127 | Y1, m | (x, y)1, m |
| Tm | 221 | 221 | 110 | Y2, m | (x, y)2, m |
| Tm | 187 | 187 | 93 | Y3, m | (x, y)3, m |
| | | | ... | | |
| Tm | 17 | 17 | 8 | Y8, m | (x, y)8, m |

Color models of the type shown in tables 9 and 10 may be constructed for any desired color (i.e., any suitable R:G:B ratio). In general, any suitable color model may be used to determine adjustment values for a given color. If desired, the color model that is used to determine adjustment values for a given color may be chosen based on which color model offers the most accurate compensation for changes in display temperature.

Moreover, the color models may be a function of multiple input parameters, as opposed to a function of temperature alone. The RGB values, luminance values and chromaticity values may be recorded for multiple input parameters. For example, RGB values may be recorded for combinations of input parameters such as brightness and temperature. Further, the RGB values, luminance values and chromaticity values may be recorded at multiple temperatures at a first brightness level, a second brightness level and so on. Similar to previously discussed methods, the RGB values may be used to determine adjustment values such as attenuation factors. Additionally, interpolation may be used to determine adjustment values for any combination of input parameters and by employing the previously recorded RGB values, luminance values, chromaticity values for the various combinations of input parameters.

As the RGB adjustment value table includes a finite number of entries, it may occur that the actual operating temperature of a display falls between temperatures for which entries exist in the RGB adjustment value table. Certain embodiments may use the existing entries of the RGB adjustment value table to interpolate adjustment values for such interim temperatures. The adjustment values corresponding to the interim temperature may be interpolated based on the adjustment values of the entries in the table bounding the interim temperature (e.g., the adjustment values for the nearest temperature above the current operating temperature and the nearest temperature below the current operating temperature).

Certain embodiments use linear interpolation to calculate the adjustment value for the interim temperature, while others may use a different form of interpolation. Any known form of interpolation may be employed by various embodiments. Accordingly, RGB values may be determined for display temperatures that are not included in the existing RGB table. Moreover, it may be possible to increase the granularity of the temperatures and corresponding RGB values by interpolating between the existing RGB values and determining additional RGB values for temperatures not originally included in the RGB table. In another embodiment, previous adjustment values may be used to determine a trend and/or a slope of change in adjustment values to more accurately interpolate the next value.

Although the RGB values, luminance measurements and chromaticity measurements have been discussed herein as a function of temperature, alternative embodiments may adjust the color output of a display based on other parameters. For example, the RGB values, luminance and chromaticity may be sampled as a function of other parameters including, but not limited to, time, brightness settings, the age of the display or any combination thereof. Accordingly, the RGB table and adjustment constants generated or employed by an embodiment would account for such parameters.

Figure 14:
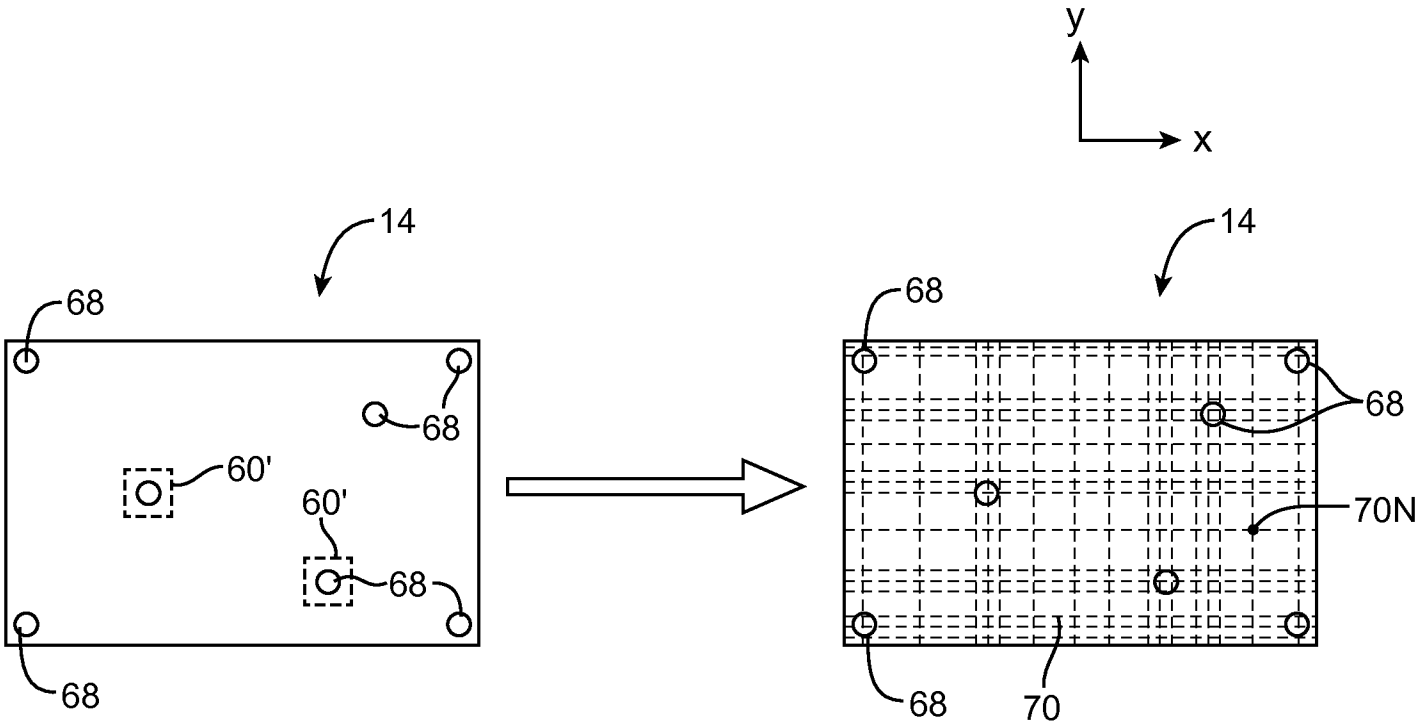
FIG. 14 is a diagram showing how temperatures measured at critical locations on a display may be used to determine temperatures at additional locations on the display in accordance with an embodiment of the present invention.

FIG. 14 is a diagram showing how the display temperature at an individual pixel in display 14 may be determined.

As shown in FIG. 14, display 14 may include locations such as critical locations 68 that are known to experience warmer or colder temperatures compared to other portions of display 14. Critical locations 68 may be locations near the corners of display 14, locations near the edges of display 14, locations near a graphics processing unit, locations near light-emitting diodes, or other critical locations on display 14 that experience relatively hot or cold temperatures. Critical locations 68 may be determined during calibration operations (e.g., using a thermographic camera such as camera 40 of FIG. 10).

During operation of device 10, thermal sensor 60 (FIG. 5) may periodically supply temperature information to display control circuitry 28. The temperature information may include display temperatures associated with critical locations 68 on display 14. For example, if there are seven predetermined critical locations 68 on display 14, thermal sensor 60 may periodically supply seven temperature readings respectively associated with the seven critical locations.

Different methods may be employed to determine the temperature at locations 68. For example, temperatures may be obtained using an open loop system in which the current operating conditions of device 10 and/or display 14 are used to estimate the temperature at different locations on display 14. The estimates may, for example, be based on device characterization information obtained during manufacturing (e.g., display temperature distribution information). With this type of configuration, temperatures at different locations on display 14 may be estimated by display control circuitry 28 without input from a thermal sensor.

In another suitable embodiment, temperatures at different locations on display 14 may be obtained using a closed loop system in which a thermal sensor such as thermal sensor 60 is used to measure one or more temperatures associated with device 10. For example, thermal sensor 60 may include a single temperature sensor that measures the temperature at a particular location in device 10. This temperature may in turn be used to estimate the temperature at other locations in device 10 such as different locations on display 14 (e.g., locations 68). The estimates may be based on device characterization information obtained during manufacturing (e.g., display temperature distribution information). As another example, thermal sensor 60 may include multiple local temperature sensors such as local temperature sensors 60' configured to measure the temperature locally at the desired locations (e.g., locations 68).

Interpolation methods may be used to determine the temperature at a given pixel in display 14 based on the temperatures at critical locations 68. For example, bilinear interpolation may be used to interpolate a temperature value for each pixel in display 14 based on the temperature values at locations 68.

As another example, Inverse Distance Weighting may be used to extend the temperatures at locations 68 to a grid of temperatures at additional locations. As shown in FIG. 14, a temperature grid such as temperature grid 70 may be generated from the temperatures measured at locations 68. Temperature grid 70 may, for example, be a non-equidistant grid having a relatively high density of nodes 70N in portions of display 14 that exhibit steep temperature gradients (e.g., in regions near critical locations 68) and a relative low density of nodes 70N in portions of display 14 that do not exhibit steep temperature gradients. Using variable grid sizes in this way may reduce the burden on processing circuitry in device 10 by requiring fewer temperature calculations in portions of display 14 where the temperature gradient is substantially flat.

This is, however, merely illustrative. If desired, temperature grid 70 may be an equidistant grid with a uniform distribution of nodes 70N.

To determine the temperature at nodes 70N of grid 70, interpolation methods such as Inverse Distance Weighting may be used. For example, the following Inverse Distance Weighting algorithm may be used to obtain the temperature T(k) at each point k on display 14 (e.g., at each node 70N):

$$T(k) = \sum_{i=1}^{N} \frac{w_i(k) \cdot T(i)}{\sum_{j=1}^{N} w_j(k)} \tag{2}$$

where $$w_i(k) = \frac{1}{d(k, k_i)^{P(i)}} \tag{3}$$

where N is the number of critical locations 68 for which temperatures are known, $d(k,k_i)$ is the distance between point k and the $i^{th}$ critical location 68, T(i) is the temperature at the $i^{th}$ critical location 68, and P(i) is a constant proportional to the temperature gradient of display 14 at the $i^{th}$ critical location 68. For example, if the temperature gradient at the $i^{th}$ location on display 14 is relatively low, then the value of P may also be relatively low (e.g., P may be equal to 1). If the temperature gradient at the $i^{th}$ location on display 14 is relatively high, then the value of P may also be relatively high (e.g., P may be equal to 3). The temperature gradient of display 14 may be measured during calibration operations (e.g., using a thermographic camera such as camera 40 of FIG. 10 or using other suitable methods).

The value of P(i) may be inversely proportional to the amount of weight given to the temperature at the $i^{th}$ location. This may ensure that locations with high temperature gradients such as hotspots do not skew the estimated temperature at locations on display 14 outside of the hotspot region. The value of P may be different for each point 68 or, if desired, may the same for all points 68 (e.g., where P(i)=P).

Temperatures may be calculated for every node 70N on grid 70, allowing for two-dimensional color correction in display 14 (e.g., in which a pixel's location along the X and Y-axes is used to determine the temperature of that pixel). This is, however, merely illustrative. If desired, one-dimensional (1D) color correction may be used. In 1D color correction, the temperature of a pixel may be determined based on that pixel's location along the X-axis only (e.g., where all nodes 70N in a column of grid 70 are assumed to have the same temperature) or along the Y-axis only (e.g., where all nodes 70N in a row of grid 70 are assumed to have the same temperature).

If desired, the type of color correction performed (i.e., 0D, 1D, or 2D) may change as the operating conditions of device 10 change. For example, in low power operating conditions (e.g., when device 10 is idle and the display backlight is powered low or off), display control circuitry 28 may perform 0D ("global") color correction in which adjustment values for all pixels in display 14 are determined based on one display temperature (e.g., the temperature at the center of the screen or at any other suitable location on display 14). In a medium power operating condition (e.g., when device 10 is idle and the display backlight is powered high), display control circuitry 28 may perform 1D color correction in which adjustment values for all pixels in a given row or column are determined based on one display temperature associated with that row or column. In a high power operating condition (e.g., when device 10 is active and the display backlight is powered high), display control circuitry 28 may perform 2D color correction in which adjustment values for each individual pixel are determined based on the display temperature at the individual pixel.

This is, however, merely illustrative. If desired, display control circuitry 28 may perform 1D or 2D color correction regardless of the current operating conditions of device 10.

Temperature grid 70 may be used to determine the temperature at an individual pixel in display 14. For example, linear interpolation or other interpolation methods may be used to estimate the temperature at an individual pixel based on the temperatures at surrounding nodes 70N of temperature grid 70. Display control circuitry 28 may determine an adjustment value for the individual pixel based on the local temperature at the individual pixel.

If desired, the temperatures at nodes 70N of temperature grid 70 may be determined during manufacturing (e.g., during calibration operations). For example, temperatures at nodes 70N of temperature grid 70 may be calculated for different combinations of temperatures T(i) and may be stored in device 10. With this type of configuration, display control circuitry 28 may determine which stored temperatures correspond to the measured temperatures at critical locations 68.

If desired, critical locations 68 may change (in number and/or in position) as the operating conditions of device 10 change. For example, during low power operating conditions, there may only be one critical location 68 near an edge or corner of display 14 (as an example). During high power operating conditions, there may be seven critical locations 68 near edges, corners, hotspots, cold spots, etc. If desired, the position and number of locations 68 for a given operating condition may be predetermined.

Figure 15:
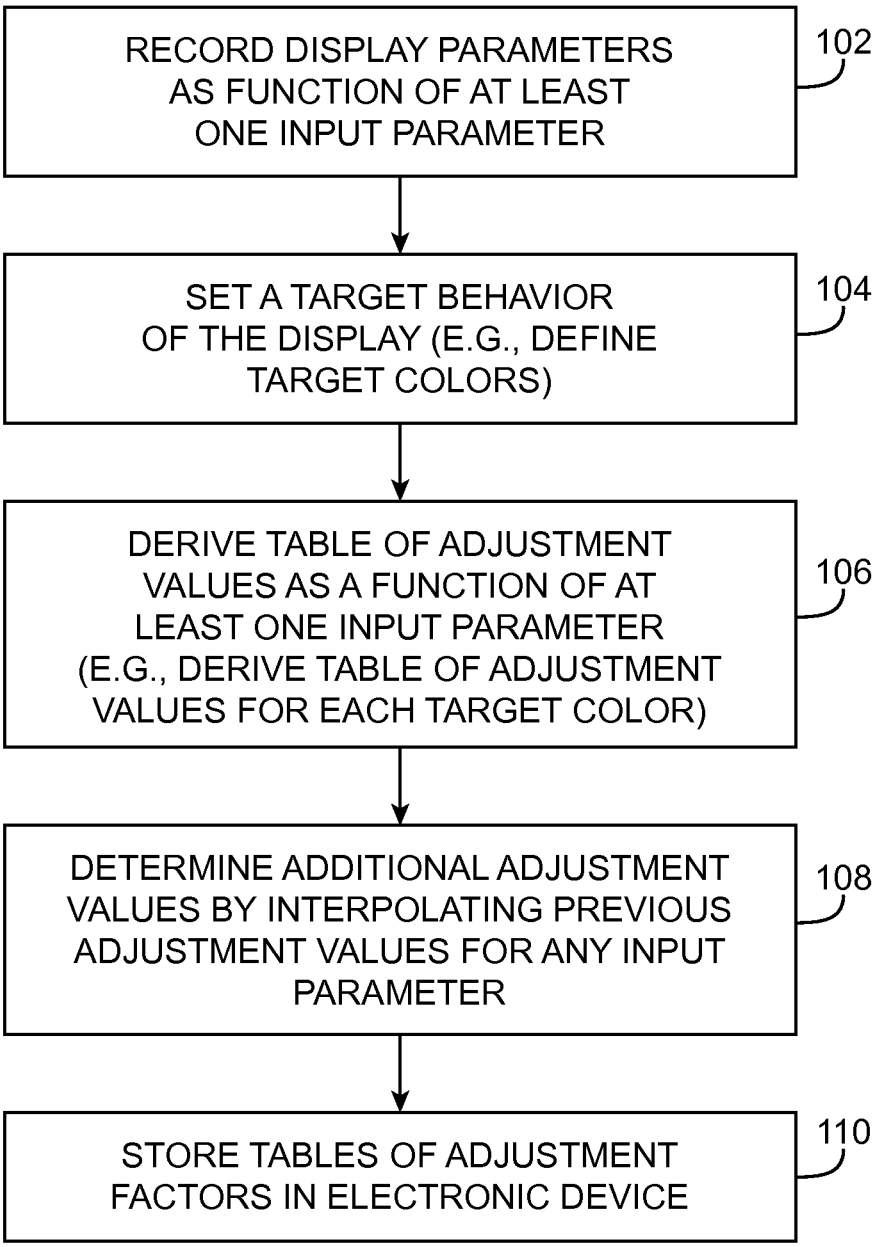
FIG. 15 is a flow chart of illustrative steps involved in obtaining tables of adjustment factors for one or more colors in accordance with an embodiment of the present invention.

FIG. 15 is a flow chart of illustrative steps involved in calibrating a display such as display 14.

At step 102, a calibration system such as calibration system 48 of FIG. 10 may be used to gather display performance data from display 14. For example, light sensor 40 may be used to gather one or more images of display 14 while display 14 is operated in a series of calibration sequences. This may include, for example, measuring luminance values Y and chromaticity values (x,y) while pixels 52 are operated at different intensity levels (e.g., while different RGB input values are provided to display pixel 52). The luminance values Y and chromaticity values (x,y) may be recorded as a function of at least one parameter or a combination of parameters. The parameters may be temperature, time, brightness, ambient light, the aging of the display, or any combination thereof. Temperature information such as display temperature may be provided to calibration computing equipment 46 using a thermal sensor in device 10 such as temperature sensor 60.

Additionally, other data values may be recorded (and thus adjusted) such as contrast, tone reproduction curves, or any other visual parameter of the display. The luminance and chromaticity values may be recorded over a time period such as the warming up time of a display. The intervals that the luminance and chromaticity values are recorded may vary. Generally, the intervals may be selected such that when the color of the display is adjusted, it may not be perceptible to a user.

At step 104, a target behavior of the display may be defined. This may include, for example, setting a target color (e.g., target luminance and chromaticity values) for neutral colors such as white, for yellowish colors, for greenish blue colors, for redish blue colors, for greenish red colors, etc.

At step 106, calibration computing equipment 46 may use the gathered display performance data such as the measured luminance and chromaticity values to calculate adjustment values as a function of the at least one input parameter. The adjustment values may be organized into RGB adjustment value tables. A table of adjustment values may be derived for each color in the predetermined set of colors. As previously discussed, the adjustment values may be attenuation factors for the RGB channels in display 14.

At step 108, additional adjustment values may be determined by interpolating from the temperatures and adjustment values in the RGB adjustment value tables. By employing interpolation to determine these additional adjustment values, it may be possible to determine adjustment values for any temperature. The additional adjustment values may be stored in the RGB adjustment value table.

At step 110, the RGB adjustment value tables may be stored in device 10. If desired, the RGB adjustment value tables may be stored in display control circuitry 28 in device 10 or may be stored in any other suitable location in device 10 such as storage and processing circuitry 34.

Figure 16:
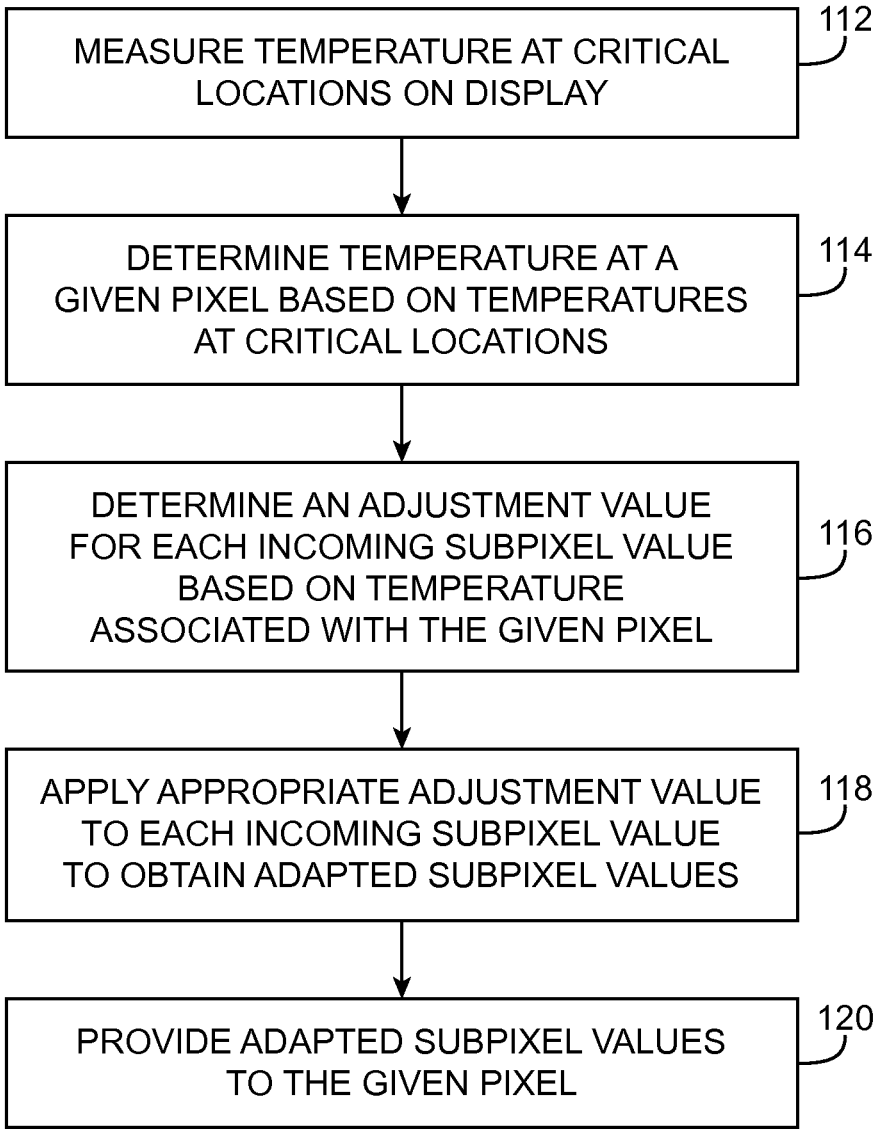
FIG. 16 is a flow chart of illustrative steps involved in adjusting incoming pixel values for a given display pixel based on a temperature at the given display pixel in accordance with an embodiment of the present invention.

FIG. 16 is a flow chart of illustrative steps involved in adjusting display colors during operation of display 14 based on temperatures measured at multiple locations on display 14.

At step 112, thermal sensor 60 may measure the temperature at critical locations 68 on display 14 (e.g., edges, corners, hotspots, cold spots, etc.). There may be one, three, five, seven, less than seven, or more than seven locations 68 on display 14 from which temperature data is gathered. Thermal sensor 60 may provide the temperatures associated with locations 68 to display control circuitry 28. In open loop configurations, display control circuitry 28 may estimate the temperatures at locations 68 based on the current operating conditions of device 10.

At step 114, display control circuitry 28 may estimate the temperature at a given pixel based on the temperatures at critical locations 68. This may include, for example, using an Inverse Distance Weighting algorithm (Equations 2 and 3) to estimate temperatures at additional locations (e.g., to estimate temperatures at each node 70N in grid 70 of FIG. 14). Display control circuitry 28 may subsequently estimate the temperature at the given pixel using the temperatures associated with the additional locations (e.g., using interpolation techniques such as bilinear interpolation).

At step 116, display control circuitry 28 may determine an adjustment value for each incoming RGB subpixel value based on the temperature associated with the given pixel. If the display temperature associated with the given pixel falls between the falls between temperatures for which entries exist in the RGB adjustment value table, the existing entries in the RGB adjustment value table may be used to interpolate adjustment values for the actual temperature associated with the given pixel.

At step 118, display control circuitry 28 may apply the appropriate adjustment value to each incoming RGB subpixel value to obtain adapted RGB subpixel values. This may include, for example, multiplying the display input value for red by a red correction coefficient, multiplying the display input value for green by a green correction coefficient, and multiplying the display input value for blue by a blue correction coefficient.

At step 120, the adapted RGB values may be provided to the given pixel in display 14.

Figure 17:
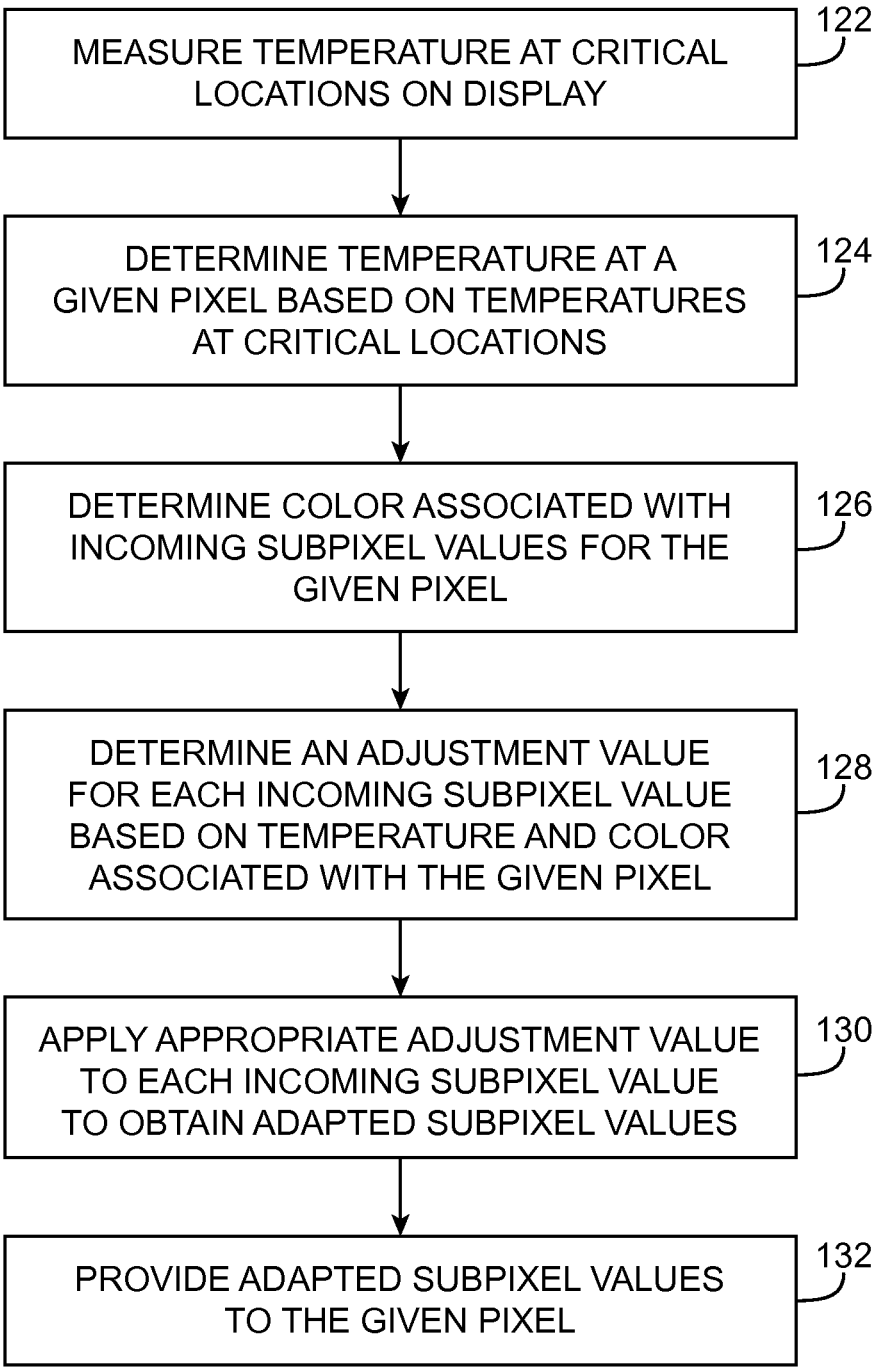
FIG. 17 is a flow chart of illustrative steps involved in adjusting incoming pixel values for a given display pixel based on a temperature at the given display pixel and based on a color to be displayed by the given display pixel in accordance with an embodiment of the present invention.

FIG. 17 is a flow chart of illustrative steps involved in adjusting display colors during operation of display 14 based on the temperatures measured at multiple locations on display 14 and based on the color to be displayed by a given pixel.

At step 122, thermal sensor 60 may measure the temperature at critical locations 68 on display 14 (e.g., edges, corners, hotspots, cold spots, etc.). There may be one, three, five, seven, less than seven, or more than seven locations 68 on display 14 from which temperature data is gathered. Thermal sensor 60 may provide the temperatures associated with locations 68 to display control circuitry 28. In open loop configurations, display control circuitry 28 may estimate the temperatures at locations 68 based on the current operating conditions of device 10.

At step 124, display control circuitry 28 may estimate the temperature at a given pixel based on the temperatures at critical locations 68. This may include, for example, using an Inverse Distance Weighting algorithm (Equation 2) to estimate temperatures at additional locations (e.g., to estimate temperatures at each node 70N in grid 70 of FIG. 14). Display control circuitry 28 may subsequently estimate the temperature at the given pixel using the temperatures associated with the additional locations (e.g., using interpolation techniques such as bilinear interpolation).

At step 126, display control circuitry 28 may receive incoming RGB subpixel values (which may sometimes be referred to as input RGB values, data, display data, digital display control values, or display control signals) and may determine the color associated with the incoming RGB values. If desired, display control circuitry 28 may optionally linearize the incoming subpixel values to remove display gamma non-linearity (e.g., if the display gamma is not equal to one). If the display gamma is equal to one, the step of linearizing the incoming RGB values may be omitted.

At step 128, display control circuitry 28 may determine an adjustment value for each incoming RGB subpixel value based on the temperature and color associated with the given pixel.

This may include, for example, determining which RGB adjustment value table most closely corresponds to the color associated with the incoming RGB values. If the color associated with the incoming RGB values does not exactly match one of the colors for which adjustment values have been stored, interpolation techniques may be used to determine an appropriate set of adjustment values based on the color associated with the incoming RGB values. For example, a combination of Inverse Distance Weighting and Delaunay Triangulation may be used to interpolate RGB adjustment values for the incoming RGB values.

If the display temperature associated with the given pixel falls between the falls between temperatures for which entries exist in the RGB adjustment value table, the existing entries in the RGB adjustment value table may be used to interpolate adjustment values for the actual temperature associated with the given pixel.

At step 130, display control circuitry 28 may apply the appropriate adjustment value to each incoming RGB subpixel value to obtain adapted RGB subpixel values. This may include, for example, multiplying the display input value for red by a red correction coefficient, multiplying the display input value for green by a green correction coefficient, and multiplying the display input value for blue by a blue correction coefficient.

At step 132, the adapted linearized subpixel values may then optionally be de-linearized (e.g., to restore the non-linear display gamma) to obtain adapted subpixel vales R', G', and B'. The adapted RGB values may then be supplied to the given pixel in display 14.

The foregoing is merely illustrative of the principles of this invention and various modifications can be made by those skilled in the art without departing from the scope and spirit of the invention. The foregoing embodiments may be implemented individually or in any combination.

What is claimed is:

1. A method for displaying data on a display that has an array of display pixels, wherein the display has display control circuitry that supplies the data to each of the display pixels, the method comprising:

determining temperatures at a plurality of locations on the display;

determining a temperature at at least one display pixel based on the temperatures at the plurality of locations on the display using inverse distance weighting;

with the display control circuitry, determining adjustment values for the at least one display pixel based on the temperature at the at least one display pixel;

applying the adjustment values to incoming pixel values to obtain adapted pixel values; and supplying the adapted pixel values to the at least one display pixel to display the data.

2. The method defined in claim 1 wherein determining the temperature at the least one display pixel comprises determining the temperature at the at least one display pixel based on a temperature gradient of the display.

3. The method defined in claim 1 wherein the at least one display pixel comprises a red subpixel, a green subpixel, and a blue subpixel, and wherein determining the adjustment values comprises determining a red adjustment value for the red subpixel, a green adjustment value for the green subpixel, and a blue adjustment value for the blue pixel.

4. The method defined in claim 1 wherein determining the temperatures at the plurality of locations on the display comprises estimating the temperatures at the plurality of locations on the display based on current operating conditions of the display.

5. The method defined in claim 1 wherein determining the temperatures at the plurality of locations on the display comprises determining the temperatures at the plurality of locations on the display using at least one temperature sensor.

6. A method for displaying data on a display that has an array of display pixels, wherein the display has display control circuitry that supplies the data to each of the display pixels, the method comprising:

determining temperatures at a plurality of locations on the display;

with the display control circuitry, determining a color associated with incoming pixel values;

determining adjustment values for at least one display pixel based on the temperatures and the color;

applying the adjustment values to the incoming pixel values to obtain adapted pixel values;

supplying the adapted pixel values to the at least one display pixel to display the data;

prior to determining the color associated with the incoming pixel values, linearizing the incoming pixel values; and prior to supplying the adapted pixel values to the display pixel, delinearizing the adapted pixel values.

7. The method defined in claim 6 further comprising:

with the display control circuitry, determining a temperature at the at least one display pixel based on the temperatures at the plurality of locations on the display.

8. The method defined in claim 7 wherein determining the temperature at the at least one display pixel comprises determining the temperature at the at least one display pixel based on a temperature gradient of the display.

9. The method defined in claim 7 wherein determining the adjustment values comprises interpolating the adjustment values using stored adjustment values, the color associated with the incoming pixel values, and the temperature at the at least one display pixel.

10. The method defined in claim 6 wherein the incoming pixel values comprise a red value, a green value, and a blue value and wherein determining the color associated with the incoming pixel values comprises determining a ratio of the red value to the green value to the blue value.

11. The method defined in claim 6 wherein the at least one display pixel comprises a red subpixel, a green subpixel, and a blue subpixel, and wherein determining the adjustment values comprises determining a red adjustment value for the red subpixel, a green adjustment value for the green subpixel, and a blue adjustment value for the blue pixel.

12. The method defined in claim 6 wherein the adjustment values are stored in a table of adjustment values, wherein the table of adjustment values corresponds to a given color, and wherein determining the adjustment values comprises determining that the color associated with the incoming pixels corresponds to the given color associated with the table of adjustment values.

13. The method defined in claim 6 wherein determining the adjustment values comprises interpolating the adjustment values using stored adjustment values, the color associated with the incoming pixel values, and the temperature at the at least one display pixel.

* * * * *